US008028988B2

(12) United States Patent
Shakespeare et al.

(10) Patent No.: US 8,028,988 B2
(45) Date of Patent: Oct. 4, 2011

(54) APPARATUS AND METHOD FOR STABILIZING A MOVING SHEET RELATIVE TO A SENSOR

(75) Inventors: John F. Shakespeare, Savo (FI); Tarja T. Shakespeare, Savo (FI)

(73) Assignee: Honeywell International Inc., Morristown, NJ (US)

( * ) Notice: Subject to any disclaimer, the term of this patent is extended or adjusted under 35 U.S.C. 154(b) by 394 days.

(21) Appl. No.: 12/017,172

(22) Filed: Jan. 21, 2008

(65) Prior Publication Data

US 2009/0184463 A1 Jul. 23, 2009

(51) Int. Cl.
*B65H 3/06* (2006.01)

(52) U.S. Cl. ..... 271/109; 492/30; 492/32; 242/615.2; 242/615.4

(58) Field of Classification Search ..... 271/109; 242/615.2, 615.4; 492/30, 32; 226/190
See application file for complete search history.

(56) References Cited

U.S. PATENT DOCUMENTS 3,066,067 A * 11/1962 Burgess, Jr. et al. ..... 162/202
3,103,850 A 9/1963 Khoury et al.
3,386,635 A 6/1968 Nash
3,405,855 A * 10/1968 Daly et al. ..... 242/615.4
3,405,884 A * 10/1968 Patterson, Jr. ..... 242/615.2
4,207,998 A * 6/1980 Schmid ..... 226/95
4,672,841 A 6/1987 Schuster et al.
4,877,485 A 10/1989 Carson
4,938,404 A 7/1990 Helms et al.
5,199,168 A * 4/1993 Daly ..... 29/895.3
5,738,760 A 4/1998 Svanqvist et al.
5,793,486 A 8/1998 Gordan et al.
5,913,268 A * 6/1999 Jackson et al. ..... 101/420
6,074,056 A * 6/2000 Kubo et al.
6,281,679 B1 8/2001 King et al.
6,328,852 B1 * 12/2001 McGary et al. ..... 162/199
6,609,645 B1 * 8/2003 Groel et al. ..... 226/190
(Continued)

FOREIGN PATENT DOCUMENTS

DE 10 2004 007 374 B3 8/2005
(Continued)

OTHER PUBLICATIONS

International Search Report and Witten Opinion of the International Searching Authority in PCT Application No. PCT/US2007/086464 dated Apr. 8, 2008.

*Primary Examiner* — Stefanos Karmis
*Assistant Examiner* — Luis A Gonzalez
(74) *Attorney, Agent, or Firm* — Munck Carter, LLP

(57) ABSTRACT

A method includes receiving a sheet of material at a sensor assembly. The sensor assembly includes a sensor configured to measure a property of the sheet. The method also includes stabilizing the sheet with respect to the sensor using a guide roller. Stabilizing the sheet includes using the guide roller to remove at least a portion of a first boundary layer of air moving towards the guide roller and to reform at least a portion of a second boundary layer of air moving away from the guide roller. For example, the guide roller could include a plurality of grooves or openings in a surface of the guide roller, or the guide roller could include a plurality of rings spaced apart from one another. Air could move from one side of the guide roller to another side of the guide roller through the grooves, through the openings, or between the rings.

20 Claims, 5 Drawing Sheets

U.S. PATENT DOCUMENTS

| | | | | |
|---|---|---|---|---|
| 6,666,805 | B2 * | 12/2003 | Poorman | 492/35 |
| 6,743,338 | B2 | 6/2004 | Ojala et al. | |
| 6,936,137 | B2 | 8/2005 | Moeller et al. | |
| 6,941,794 | B2 * | 9/2005 | Strohmeyer et al. | 73/28.01 |
| 6,994,293 | B1 * | 2/2006 | Coburn | 242/615.2 |
| 7,146,279 | B2 | 12/2006 | Typpoe et al. | |

FOREIGN PATENT DOCUMENTS

| | | | | |
|---|---|---|---|---|
| EP | 1 112 951 | A2 | | 7/2001 |
| JP | 02008139 | A | * | 1/1990 |
| WO | WO 03/035974 | A1 | | 5/2003 |
| WO | WO 2004/015197 | A1 | | 2/2004 |

* cited by examiner

APPARATUS AND METHOD FOR STABILIZING A MOVING SHEET RELATIVE TO A SENSOR

TECHNICAL FIELD

This disclosure relates generally to measurement systems and more specifically to an apparatus and method for stabilizing a moving sheet relative to a sensor.

BACKGROUND

Sheets of material are often used in various industries and in a variety of ways. These materials can include paper, plastic, and other materials manufactured or processed in webs or sheets. As a particular example, long sheets of paper or other materials can be manufactured and collected in reels. These sheets of material are often manufactured or processed at a high rate of speed, such as speeds up to one hundred kilometers per hour or more.

It is often necessary or desirable to measure one or more properties of a sheet of material as the sheet is being manufactured or processed. For example, in a paper sheet-making process, it is often desirable to measure the properties of the sheet (such as its basis weight, moisture, color, or caliper/thickness) to verify whether the sheet is within certain specifications. Adjustments can then be made to the sheet-making process to ensure the sheet properties are within the desired range(s).

Many optical and image-based measurements involving a sheet of material often require the sheet to be confined in a specific position or plane. For example, there is often a narrow range of working distances (from a sensor to the sheet) and/or a narrow range of tilt angles (with respect to illumination or examination of the sheet) that provide proper measurements with these techniques. Deviations from the expected or required working distances, tilt angles, or other geometries may introduce bias, uncertainty, or other errors in the measurements. This problem becomes more pronounced when taking measurements of a moving sheet, which may flutter or otherwise move as it passes by or between sensors.

Existing solutions for constraining sheet position and sheet planarity are often of limited use. For example, existing solutions could stabilize a sheet for one sensor while disturbing the sheet near other sensors. Also, stationary contacting devices (such as caliper buttons) can apply friction to the sheet, which can cause unwanted markings on the sheet, increase the risk of a sheet break, and are difficult to set up (since contact pressure may be grade-dependent). Further, aerodynamic devices (such as a backstep coanda or helical vortex) often do not guarantee good sheet position or sheet planarity since, for example, sheet position may be unstable in time and can vary with sheet tension. In addition, non-stationary contacting devices (such as guide rollers) often cannot guarantee good sheet position or sheet planarity since there is a substantial boundary layer of air moving with the sheet, typically resulting in overpressure where the sheet attaches to a guide roller and underpressure where the sheet detaches from a guide roller. This can cause deflection of the sheet path between guide rollers, affecting the sheet's level and tilt and leading to sheet position instability. Moreover, overpressure, underpressure, and turbulence can vary with speed, sheet tension, and permeability (very low permeability sheets may actually "float" over the guide rollers without coming into non-slip contact with the guide rollers).

SUMMARY

This disclosure provides an apparatus and method for stabilizing a moving sheet relative to a sensor.

In a first embodiment, a method includes receiving a sheet of material at a sensor assembly, where the sensor assembly includes a sensor configured to measure a property of the sheet. The method also includes stabilizing the sheet with respect to the sensor using a guide roller. Stabilizing the sheet includes using the guide roller to remove at least a portion of a first boundary layer of air moving towards the guide roller and to reform at least a portion of a second boundary layer of air moving away from the guide roller.

In particular embodiments, the guide roller includes a plurality of grooves in a surface of the guide roller. Also, the method includes allowing air to move from one side of the guide roller to another side of the guide roller through the grooves.

In other particular embodiments, the guide roller is substantially hollow and includes a plurality of openings in a surface of the guide roller. Also, the method includes allowing air to move from one side of the guide roller to another side of the guide roller through the openings. The air entering the guide roller could be redirected using a deflector located within the guide roller.

In yet other particular embodiments, the guide roller includes a plurality of rings spaced apart from one another. Also, the method includes allowing air to move from one side of the guide roller to another side of the guide roller between the rings. The air entering the guide roller between the rings could exit the guide roller through one or more areas between the rings and/or an exhaust located at an end of the guide roller.

In still other particular embodiments, stabilizing the sheet includes using multiple guide rollers. The multiple guide rollers could include two guide rollers located on opposite sides of the sheet. The multiple guide rollers could also include one or more guide rollers located prior to the sensor assembly and one or more guide rollers located after the sensor assembly.

In additional particular embodiments, the sensor is configured to measure the property of the sheet at a location where the sheet is attached to the guide roller.

In a second embodiment, a system includes a sensor assembly including a sensor configured to measure a property of a sheet. The system also includes a guide roller configured to remove at least a portion of a first boundary layer of air moving towards the guide roller and to reform at least a portion of a second boundary layer of air moving away from the guide roller.

In a third embodiment, a guide roller includes a central axle configured to be rotated. The guide roller also includes a surface having at least one passage configured to remove at least a portion of a first boundary layer of air moving towards the guide roller and to reform at least a portion of a second boundary layer of air moving away from the guide roller.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 7, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
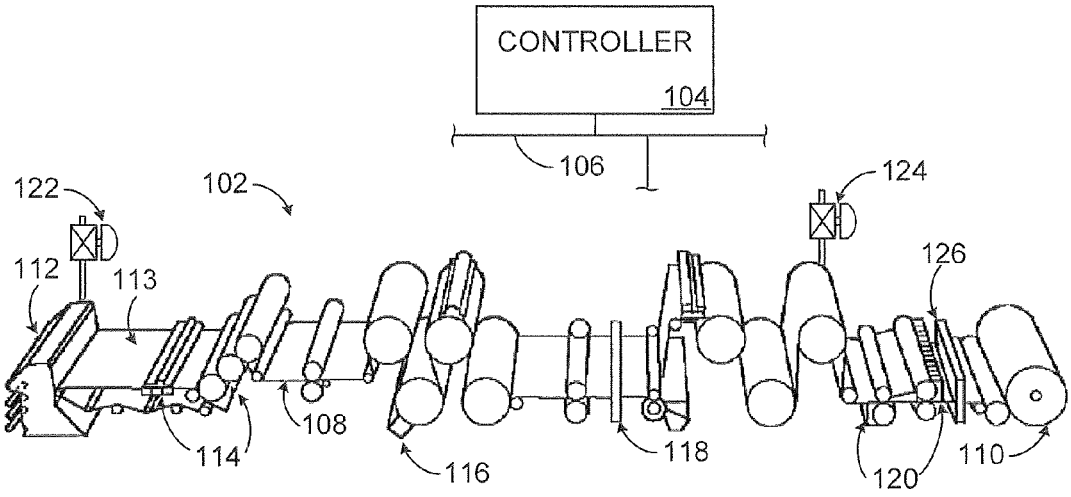
FIG. 1 illustrates an example paper production system according to one embodiment of this disclosure.

FIG. 1 illustrates an example paper production system 100 according to one embodiment of this disclosure. The embodiment of the paper production system 100 shown in FIG. 1 is for illustration only. Other embodiments of the paper production system 100 may be used without departing from the scope of this disclosure.

In this example, the paper production system 100 includes a paper machine 102, a controller 104, and a network 106. The paper machine 102 includes various components used to produce a paper product. In this example, the various components may be used to produce a paper sheet 108 collected at a reel 110. The controller 104 monitors and controls the operation of the paper machine 102, which may help to maintain or increase the quality of the paper sheet 108 produced by the paper machine 102.

In this example, the paper machine 102 includes a headbox 112, which distributes a pulp suspension uniformly across the machine onto a continuous moving wire screen or mesh 113. The pulp suspension entering the headbox 112 may contain, for example, 0.2-3% wood fibers, fillers, and/or other materials, with the remainder of the suspension being water. The headbox 112 may include an array of dilution actuators, which distributes dilution water into the pulp suspension across the sheet. The dilution water may be used to help ensure that the resulting paper sheet 108 has a more uniform basis weight across the sheet 108. The headbox 112 may also include an array of slice lip actuators, which controls a slice opening across the machine from which the pulp suspension exits the headbox 112 onto the moving wire screen or mesh 113. The array of slice lip actuators may also be used to control the basis weight of the paper or the distribution of fiber orientation angles of the paper across the sheet 108.

An array of drainage elements 114, such as vacuum boxes, removes as much water as possible. An array of steam actuators 116 produces hot steam that penetrates the paper sheet 108 and releases the latent heat of the steam into the paper sheet 108, thereby increasing the temperature of the paper sheet 108 in sections across the sheet. The increase in temperature may allow for easier removal of water from the paper sheet 108. An array of rewet shower actuators 118 adds small droplets of water (which may be air atomized) onto the surface of the paper sheet 108. The array of rewet shower actuators 118 may be used to control the moisture profile of the paper sheet 108, reduce or prevent over-drying of the paper sheet 108, or correct any dry streaks in the paper sheet 108.

The paper sheet 108 is then often passed through a calender having several nips of counter-rotating rolls. Arrays of induction heating actuators 120 heat the shell surfaces of various ones of these rolls. As each roll surface locally heats up, the roll diameter is locally expanded and hence increases nip pressure, which in turn locally compresses the paper sheet 108. The arrays of induction heating actuators 120 may therefore be used to control the caliper (thickness) profile of the paper sheet 108. The nips of a calender may also be equipped with other actuator arrays, such as arrays of air showers or steam showers, which may be used to control the gloss profile or smoothness profile of the paper sheet.

Two additional actuators 122-124 are shown in FIG. 1A. A thick stock flow actuator 122 controls the consistency of the incoming stock received at the headbox 112. A steam flow actuator 124 controls the amount of heat transferred to the paper sheet 108 from drying cylinders. The actuators 122-124 could, for example, represent valves controlling the flow of stock and steam, respectively. These actuators may be used for controlling the dry weight and moisture of the paper sheet 108. Additional components could be used to further process the paper sheet 108, such as a supercalender (for improving the paper sheet's thickness, smoothness, and gloss) or one or more coating stations (each applying a layer of coatant to a surface of the paper to improve the smoothness and printability of the paper sheet). Similarly, additional flow actuators may be used to control the proportions of different types of pulp and filler material in the thick stock and to control the amounts of various additives (such as retention aid or dyes) that are mixed into the stock.

This represents a brief description of one type of paper machine 102 that may be used to produce a paper product. Additional details regarding this type of paper machine 102 are well-known in the art and are not needed for an understanding of this disclosure. Also, this represents one specific type of paper machine 102 that may be used in the system 100. Other machines or devices could be used that include any other or additional components for producing a paper product. In addition, this disclosure is not limited to use with systems for producing paper products and could be used with systems that process the produced paper or with systems that produce or process other items or materials, such as plastic, textiles, metal foil or sheets, or other or additional materials that are manufactured or processed as moving sheets.

In order to control the paper-making process, one or more properties of the paper sheet 108 may be continuously or repeatedly measured. The sheet properties can be measured at one or various stages in the manufacturing process. This information may then be used to adjust the paper machine 102, such as by adjusting various actuators within the paper machine 102. This may help to compensate for any variations of the sheet properties from desired targets, which may help to ensure the quality of the sheet 108.

As shown in FIG. 1A, the paper machine 102 includes a scanner 126, which may include one or more sensors. The scanner 126 is capable of scanning the paper sheet 108 and measuring one or more characteristics of the paper sheet 108. For example, the scanner 126 could include sensors for measuring the weight, moisture, caliper (thickness), gloss, color, smoothness, or any other or additional characteristics of the paper sheet 108.

As described in more detail below, one or more guide rollers can be used to stabilize the paper sheet 108 relative to sensors in the scanner. For example, guide rollers could be placed before and/or after the sensors in the scanner. The guide rollers could help to stabilize the sheet 108 so that the sensors can take proper measurements of the sheet 108, such as by stabilizing the sheet 108 is a specified position or plane. Also, the guide rollers can be vented, meaning the guide rollers have passages where air traveling with the sheet 108

(called "boundary layers") can be removed and then reformed. This can be done in a manner that reduces or prevents the boundary layers from disrupting the position of the sheet 108. Additional details regarding the use of vented guide rollers are provided in FIGS. 2 through 5B, which are described below.

The scanner 126 includes any suitable structure or structures for measuring or detecting one or more characteristics of the paper sheet 108, such as sets or arrays of sensors. A scanning or moving set of sensors represents one particular embodiment for measuring sheet properties. Other embodiments could be used, such as those using stationary sets or arrays of sensors, deployed in one or a few locations across the sheet or deployed in a plurality of locations across the whole width of the sheet such that substantially the entire sheet width is measured.

The controller 104 receives measurement data from the scanner 126 and uses the data to control the paper machine 102. For example, the controller 104 may use the measurement data to adjust the various actuators in the paper machine 102 so that the paper sheet 108 has properties at or near desired properties. The controller 104 includes any hardware, software, firmware, or combination thereof for controlling the operation of at least part of the paper machine 102. In particular embodiments, the controller 104 may represent a proportional-integral-derivative (PID) controller or a cross-direction machine-direction (CDMD) model predictive controller (MPC).

The network 106 is coupled to the controller 104 and various components of the paper machine 102 (such as the actuators and the scanner 126). The network 106 facilitates communication between components of system 100. The network 106 represents any suitable network or combination of networks facilitating communication between components in the system 100. The network 106 could, for example, represent a wired or wireless Ethernet network, an electrical signal network (such as a HART or FOUNDATION FIELDBUS network), a pneumatic control signal network, or any other or additional network(s).

Although FIG. 1 illustrates one example of a paper production system 100, various changes may be made to FIG. 1. For example, other systems could be used to produce paper products or other products. Also, while shown as including a single paper machine 102 with various components and a single controller 104, the production system 100 could include any number of paper machines or other production machinery having any suitable structure, and the system 100 could include any number of controllers. In addition, FIG. 1 illustrates one operational environment in which stabilization of a sheet material can be used. This functionality could be used in any other suitable system.

Figure 2:
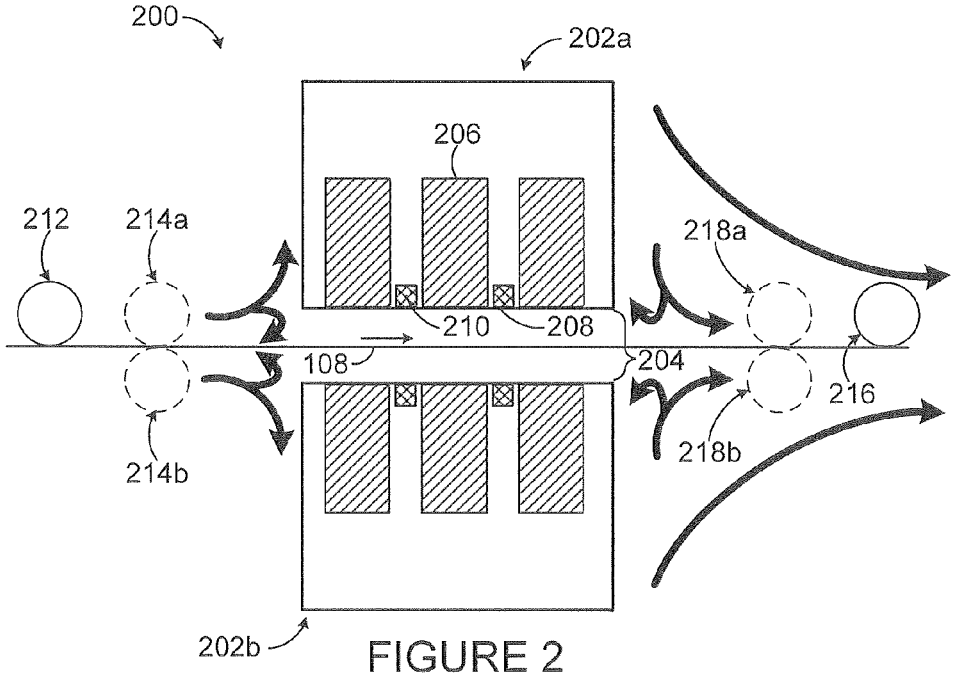
FIG. 2 illustrates an example mechanism for stabilizing a moving sheet relative to a sensor according to one embodiment of this disclosure.

FIG. 2 illustrates an example mechanism for stabilizing a moving sheet relative to a sensor according to one embodiment of this disclosure. More specifically, FIG. 2 illustrates an example sensor assembly or arrangement 200 for taking measurements of a sheet material and one or more guide rollers for stabilizing the sheet material. The embodiment of the mechanism for stabilizing the moving sheet shown in FIG. 2 is for illustration only. Other embodiments of the stabilizing mechanism could be used without departing from the scope of this disclosure. Also, for ease of explanation, the stabilizing mechanism is described as forming part of the paper machine 102 in the paper production system 100 of FIG. 1. The stabilizing mechanism could be used in any other manufacturing or processing system. The stabilizing mechanism could also be used to stabilize any suitable material and is not limited to use with a paper sheet.

In FIG. 2, the sensor arrangement 200 represents one example implementation of the scanner 126. In this example, the sensor arrangement 200 includes two sensor carriages 202*a*-202*b* separated by a gap 204 through which the sheet 108 travels. Each of the sensor carriages 202*a*-202*b* includes one or multiple sensors 206. The sensors 206 measure one or more characteristics of the sheet 108. For example, the sensors 206 could measure the weight, moisture, ash content, caliper (thickness), gloss, smoothness, color, brightness, opacity, porosity, or any other or additional characteristics of the sheet 108. Each sensor 206 includes any suitable structure for measuring one or more characteristics of a sheet of material, such as a photosensor, ionization chamber, spectrograph, camera, or mechanical sensor. A mechanical sensor could include a contacting or non-contacting caliper probe. In this example, each sensor 206 is located along an inner surface or wall 208 of a sensor carriage and directed perpendicular to the sheet 108. However, each sensor 206 could have any suitable arrangement and position relative to the sheet 108.

In particular embodiments, each of the sensor carriages 202*a*-202*b* also includes a mechanism for measuring the sheet position at one or more locations. For example, one or more of the sensor carriages 202*a*-202*b* could include at least one position sensor 210, which could use any suitable technique to identify a distance or location of the sheet 108. Suitable techniques for measuring the position could include triangulation using a projected optical pattern and an image detector, which allows the sheet position and aplanarity to be measured. In these embodiments, the position of the sheet 108 and the sheet aplanarity can be measured or inferred from measurements of the sheet's position at a sufficient number of locations.

In this example, the sheet 108 is moving left to right in FIG. 2 through the gap 204 between the sensor carriages 202*a*-202*b*. As shown here, there are various boundary layers or air flows associated with movement of the sheet 108. For example, boundary layers of air could form above and below the sheet 108 on either side of the sensor carriages 202*a*-202*b*. These air flows can, among other things, form large-scale turbulent overpressure at the entrance to the gap 204 and large-scale turbulent underpressure at the exit of the gap 204. Without the use of a stabilization mechanism, a free sheet 108 could move within the gap 204, creating an unstable or unknown position or tilt of the sheet 108 that can adversely affect any measurements taken by the sensors 206.

To facilitate stabilization of the sheet 108, one or more vented guide rollers can be placed on one or both sides of the sensor carriages 202*a*-202*b*. The vented guide rollers can help to stabilize the sheet 108 prior to entering the gap 204 and/or after exiting the gap 204. In this way, the vented guide rollers can help to reduce or prevent movement of the sheet 108 within the gap 204, helping to improve measurements taken by the sensors 206.

In this example, the vented guide rollers could include a guide roller 212 and a guide roller 214*a* or 214*b* prior to the gap 204. The guide rollers could be on the same side of the sheet 108 or on opposite sides of the sheet 108 (which is why the guide roller 214*a* or 214*b* is illustrated in two positions using dashed circles). Also, it may be noted that a single guide roller or more than two guide rollers could be used prior to the gap 204.

Similarly, the vented guide rollers could also or alternatively include a guide roller 216 and a guide roller 218*a* or 218*b* after the gap 204. Again, the guide rollers could be on the same side of the sheet 108 or on opposite sides of the sheet 108 (which is why the guide roller 218*a* or 218*b* is illustrated in two positions using dashed circles). Also, it may be noted that a single guide roller or more than two guide rollers could be used after the gap 204. Depending on the implementation, one or more guide rollers could be used on a single side of the gap 204, or one or more guide rollers could be used on each side of the gap 204.

As described in more detail below, the guide rollers are vented, and shell surfaces of the guide rollers are not smooth and uninterrupted. Rather, the shell surfaces of the guide rollers have various structures that allow air to escape through the guide rollers during operation. In this way, the guide rollers can help to remove the boundary layers of air where the sheet 108 attaches to the guide rollers and to reform the boundary layers of air where the sheet 108 detaches from the guide rollers. This can help to reduce or eliminate overpressure and underpressure conditions as the sheet 108 passes over the guide rollers, which can stabilize the sheet 108 within the gap 204.

Although FIG. 2 illustrates one example of a mechanism for stabilizing a moving sheet 108 relative to a sensor, various changes may be made to FIG. 2. For example, any number of sensor carriages 202*a*-202*b* could be used (including a single sensor carriage). Also, each sensor carriage could include any number of sensors 206 in any suitable arrangement, and each sensor carriage may or may not include one or more position sensors 210. Further, the overall shape of each sensor carriage is for illustration only, and each sensor carriage could have any other shape or shapes (whether or not the shapes match) As a particular example, the sensor carriages 202*a*-202*b* could have the same shape (and use the same air flow techniques) shown and described in U.S. patent application Ser. No. 11/636,895, which is hereby incorporated by reference. In addition, any number of vented guide rollers can be used in any suitable location(s) and configuration(s) in the system 100 or other system.

FIGS. 3A through 5B illustrate example vented guide rollers for stabilizing a moving sheet relative to a sensor according to one embodiment of this disclosure. The embodiments of the vented guide rollers shown in FIGS. 3A through 5B are for illustration only. Other embodiments of the vented guide rollers could be used without departing from the scope of this disclosure. Also, for ease of explanation, the vented guide rollers may be described with respect to the guide rollers 212-218*b* shown in FIG. 2, which are used in the system 100 of FIG. 1. The vented guide rollers could be used in any other or additional system and in conjunction with any suitable sensor carriage. The vented guide rollers could also be used to stabilize any suitable material and are not limited to use with a paper sheet.

Figure 3A:
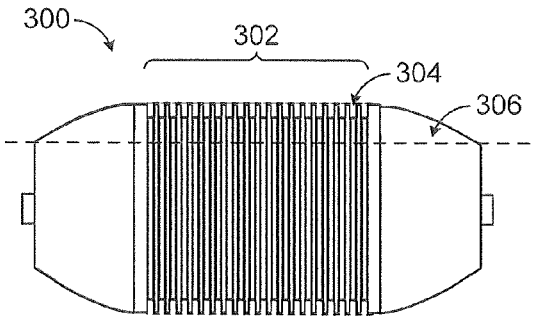
FIGS. 3A through 5B illustrate example vented guide rollers for stabilizing a moving sheet relative to a sensor according to one embodiment of this disclosure.
Figure 3B:
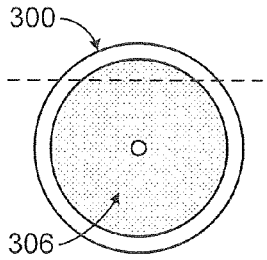

FIGS. 3A and 3B illustrate a first vented guide roller 300, where FIG. 3A is a front view of the roller 300 and FIG. 3B is an end view of the roller 300. In this example, the vented guide roller 300 is a generally solid roll with a grooved shell surface 302. Grooves 304 in the grooved surface 302 could have any suitable dimensions. For instance, the grooves 304 could be about 2-3 millimeters in depth, about 1-2 millimeters in width, and about 1-2 millimeters apart. However, the grooves 304 could have any other uniform or non-uniform depth, width, or spacing. The vented guide roller 300 also includes tapered ends 306, each of which generally tapers from a wider cross-section near the grooved surface 302 to a smaller cross-section at the edge of the vented guide roller 300, and each of which may or may not be grooved. The dashed line in FIGS. 3A and 3B could represent the location of the inner surface or wall 208 of one of the sensor carriages 202*a*-202*b* (although the vented guide roller 300 could be placed in any other suitable location).

The vented guide roller 300 could be formed from any suitable material(s) and in any suitable manner. For example, the vented guide roller 300 could be formed from one or more metals. Also, the vented guide roller 300 could be formed by die-casting or other technique, followed by etching the roller to form the grooves 304.

In this embodiment, the grooves 304 allow the vented guide roller 300 to draw air from its ingress side (where the sheet 108 attaches to the roller 300) and to expel air from its egress side (where the sheet 108 detaches from the roller 300). This may allow the vented guide roller 300 to remove boundary layers of air from its ingress side and to reform boundary layers of air at its egress side. The roller 300 could also touch the sheet 108 with minimal deflection at its ingress and egress sides. If multiple rollers 300 are used on a single side of a sensor carriage (such as in a dual roll configuration), the path of the sheet 108 could be minimally disturbed from a line that is mutually tangent to the multiple rollers 300, thereby providing good sheet positioning and sheet planarity. It may be noted that, in some embodiments, the grooves 304 can be cleaned periodically or at other times to remove accumulated dirt or other materials and to avoid groove clogging.

In FIG. 3A, the grooves 304 are shown extending over substantially all of the cylindrical part of the guide roller 300, and the guide roller 300 is shown with tapered ends which do not have grooves. In other embodiments, the guide roller 300 need not have tapered ends and could be substantially cylindrical with grooves on the cylindrical surface. Also, the grooves 304 could extend over less than the whole of the cylindrical part or the guide roller 300, such as by having a non-grooved region near either or both ends of the cylindrical part of the guide roller 300. Similarly, grooves 304 could be provided on part or all of either or both tapered ends of the guide roller 300 (if the guide roller 300 is provided with tapered ends).

Figure 4A:
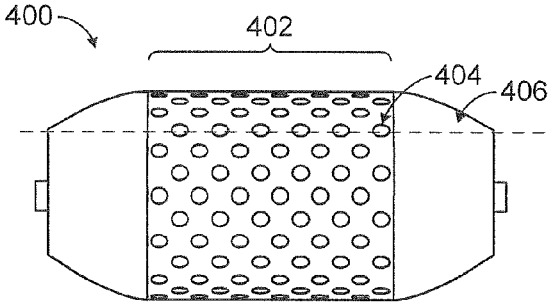
Figure 4B:
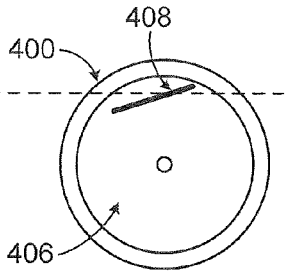

FIGS. 4A and 4B illustrate a second vented guide roller 400, where FIG. 4A is a front view of the roller 400 and FIG. 4B is an end view of the roller 400. In this example, the vented guide roller 400 is a generally hollow roll with a perforated shell surface 402. Openings 404 in the perforated surface 402 could have any suitable shape and dimensions. For instance, the openings 404 could be circular, rectangular, hexagonal, or other shape(s), although different openings 404 could have different shapes. Also, the openings 404 could be about 1-2 millimeters in size and about 1 millimeter apart, although the openings 404 could have different sizes or spacings. Further, the openings 404 (or subsets of openings) could be arranged randomly, pseudo-randomly, or in a regular lattice pattern. The vented guide roller 400 also includes tapered ends 406, each of which may or may not be perforated (may or may not include openings 404). Again, the dashed line in FIGS. 4A and 4B could represent the location of the inner surface or wall 208 of one of the sensor carriages 202*a*-202*b* (although the vented guide roller 400 could be placed in any other suitable location).

The vented guide roller 400 could be formed from any suitable material(s) and in any suitable manner. For example, the vented guide roller 400 could be formed from one or more metals. Also, the vented guide roller 400 could be formed using a metal sheet that is given a cylindrical shape and then drilled or otherwise etched to form the openings 404.

The vented guide roller 400 may optionally include a deflector 408 inside the roller 400 (such as inside the roll plenum) to assist in air flow control. Air traveling with the sheet 108 can enter the guide roller 400 through the openings 404, and the deflector 408 can deflect the air and change its direction of travel. The air can then exit the guide roller 400 in a direction different (compared to its entry direction). The deflector 408 represents any suitable structure for deflecting air, such as a flexible or rigid plate.

In this embodiment, the openings 404 allow the roller 400 to draw air from its ingress side and to expel air from its egress side. This may allow the vented guide roller 400 to remove boundary layers of air from its ingress side and to reform boundary layers of air at its egress side. The deflector 408 can assist in moving air from the "attachment" side of the roller 400 to the "detachment" side of the roller 400. Again, the roller 400 could touch the sheet 108 with minimal deflection at its ingress and egress sides and, if multiple rollers 400 are used together, the path of the sheet 108 could be minimally disturbed from a line that is mutually tangent to the multiple rollers 400.

In FIG. 4A, the openings 404 are shown extending over substantially all of the cylindrical part of the guide roller 400, and the guide roller 400 is shown with tapered ends that do not have openings 404. In other embodiments, the guide roller 400 need not be constructed with tapered ends and could be substantially cylindrical with openings 404 on the cylindrical surface. Also, the openings 404 could extend over less than the whole of the cylindrical part of the guide roller 400, such as by having a non-perforated region near either or both ends of the cylindrical part of the guide roller 400. Similarly, openings 404 could be provided on part or all of either or both tapered ends of the guide roller 400 (if the guide roller 400 is provided with tapered ends).

Figure 5A:
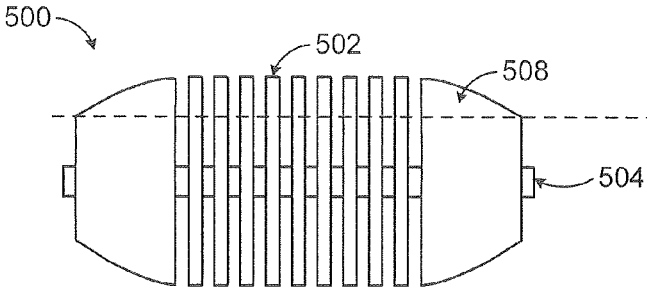
Figure 5B:
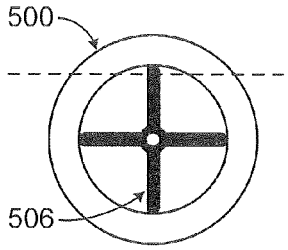

FIGS. 5A and 5B illustrate a third vented guide roller 500, where FIG. 5A is a front view of the roller 500 and FIG. 5B is an end view of the roller 500. In this example, the vented guide roller 500 is a generally hollow roll formed using multiple annuli or rings 502. The rings 502 could have any suitable size and shape, such as circular rings that are about 2-3 millimeters thick and spaced about 1-2 millimeters apart. Also, the inner radius of each ring 502 could, for example, be about 75% of its outer radius. Each of the rings 502 in this example is mounted on a rotating axle 504 using four spokes 506. However, the rings 502 could have uniform or non-uniform thicknesses, spacings, inner and outer radii, and number of spokes. The vented guide roller 500 also includes tapered ends 508, each of which may or may not be formed using annuli or rings. Once again, the dashed line in FIGS. 5A and 5B could represent the location of the inner surface or wall 208 of one of the sensor carriages 202*a*-202*b* (although the vented guide roller 500 could be placed in any other suitable location).

The vented guide roller 500 could be formed from any suitable material(s) and in any suitable manner. For example, the vented guide roller 500 could be formed from one or more metals. Also, the vented guide roller 500 could be formed by forming the rings 502 and then welding or otherwise coupling the rings 502 to the axle 504 using the spokes.

In FIG. 5A, the annuli or rings 502 and the spaces between them are shown extending over substantially all of the cylindrical part of the guide roller 500, and the guide roller 500 is shown with tapered ends that are not formed using annuli or rings with spaces between them. In other embodiments, the guide roller 500 need not be constructed with tapered ends and could be substantially cylindrical, formed only of annuli or rings with spaces between them. Also, the annuli or rings and the spaces between them could extend over less than the whole of the cylindrical part of the guide roller 500, such as by having a region near either or both ends of the cylindrical part of the guide roller 500 that is not formed of annuli or rings with spaces between them. Similarly, part or all of either or both tapered ends of the guide roller 500 could be formed of annuli or rings with spaces between them (if the guide roller 500 is provided with tapered ends), and the annuli or rings in this case could have a curved or angled surface profile to match the profile of a tapered end.

In this embodiment, air can be drawn into the interior of the roller 500 and can exit the interior of the roller 500 between the rings 502. This may allow the vented guide roller 500 to remove boundary layers of air from its ingress side and to reform boundary layers of air at its egress side. If necessary or desired, an exhaust can be provided at one or both ends of the roller 500 to provide an additional path or paths for the air to exit the roller 500. The sheet 108 can be held in position against the roller 500 due to a slightly reduced air pressure at the surface of the roller 500, helping to provide a guaranteed sheet position. Depending on the shape of the roller 500, the sheet 108 may or may not have a curved surface.

Each of these vented guide rollers could be used to hold a moving sheet 108 in place. For example, a vented guide roller could hold the sheet 108 at a desired reference position within the measurement gap 204, and the vented guide roller could remain in substantially non-slip contact with the sheet 108. As another example, multiple vented guide rollers could hold the sheet 108 at a desired reference plane within the measurement gap 204, and the vented guide rollers could maintain the sheet 108 substantially in a tangent plane between the rollers (which can be in substantially non-slip contact with the sheet 108). The multiple rollers could be on the same side or on opposite sides of the sheet 108.

The vented guide rollers could also be rotated using any suitable mechanism(s). For example, the vented guide rollers could be rotated using frictional contact with the moving sheet 108. The vented guide rollers could also be rotated using electric or other motors or using forced air flows. Further, the vented guide rollers could use forced air supply and/or forced air removal to adjust attachment and detachment of the sheet 108 to the rollers. In addition, the vented guide rollers could use one or more internal deflectors (such as deflector 408) or other mechanisms to facilitate proper or desired air flow.

Although FIGS. 3A through 5B illustrate examples of vented guide rollers for stabilizing a moving sheet relative to a sensor, various changes may be made to FIGS. 3A through 5B. For example, the structure of each vented guide roller could be altered according to particular needs. Also, any other or additional vented guide rollers could be used, such as any vented guide roller having one or more passages for the movement of air through the vented guide roller (which could be done for the removal and reformation of one or more boundary layers of air).

FIGS. 6A through 6H illustrate additional mechanisms for stabilizing a moving sheet relative to a sensor according to one embodiment of this disclosure. The embodiments of the mechanisms for stabilizing the moving sheet shown in FIGS. 6A through 6H are for illustration only. Other embodiments of the stabilizing mechanisms could be used without departing from the scope of this disclosure. Also, for ease of explanation, the stabilizing mechanisms are described as forming part of the paper machine 102 in the paper production system 100 of FIG. 1. The stabilizing mechanisms could be used in any other manufacturing or processing system. The stabilizing mechanisms could also be used to stabilize any suitable material and is not limited to use with a paper sheet.

Figure 6A:
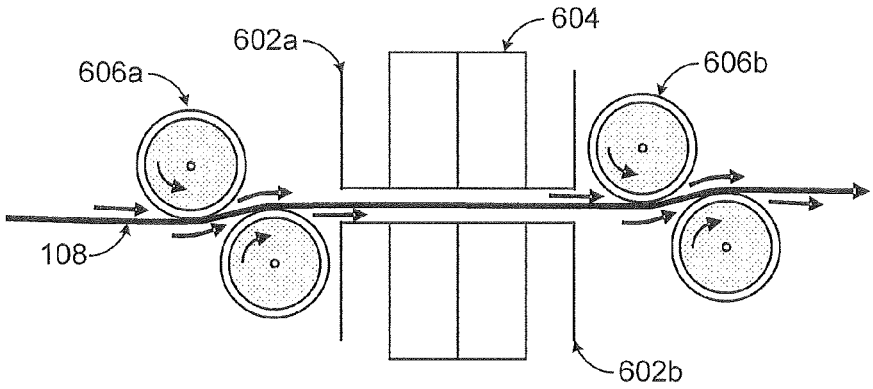
FIGS. 6A through 6H illustrate additional mechanisms for stabilizing a moving sheet relative to a sensor according to one embodiment of this disclosure.
Figure 6B:
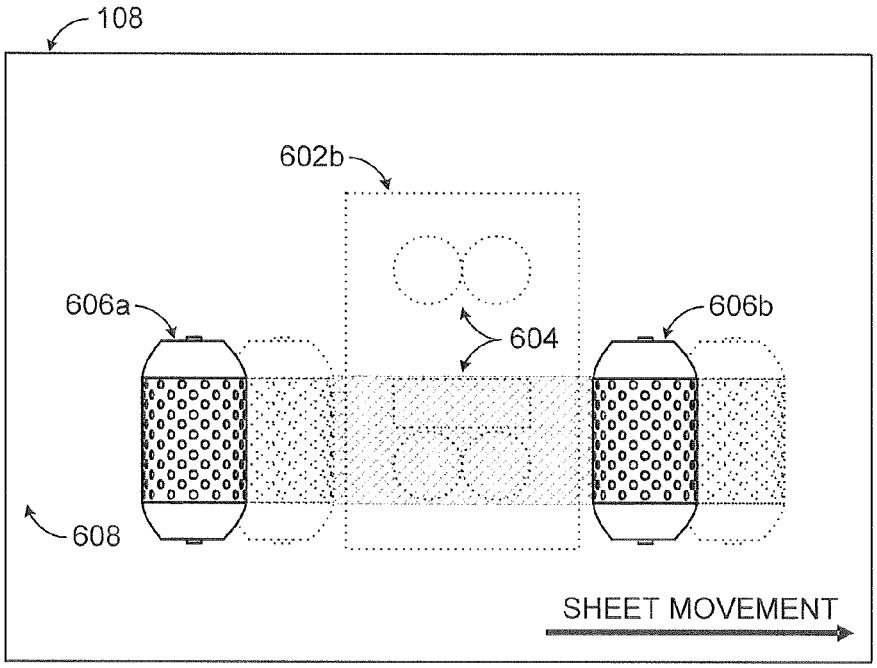

As shown in FIGS. 6A and 6B, two sensor carriages 602*a*-602*b* each include multiple sensors 604. Also, two vented guide rollers 606*a* are positioned prior to the sensor carriages 602*a*-602*b*, and two vented guide rollers 606*b* are positioned after the sensor carriages 602*a*-602*b*. The guide rollers 606*a*-606*b* could represent any suitable vented rollers for stabilizing a sheet 108, including the rollers shown in FIGS. 3A through 5B discussed above. In FIG. 6B, the upper sensor carriage 602*a* has been omitted (apart from its vented guide rollers) for clarity, and the lower sensor carriage 602*b* and its components are illustrated in dotted lines since they are located under the sheet 108 in FIG. 6B.

In this example, some of the sensors 604 take measurements of a stabilized portion of the sheet 108, which is denoted by the cross-hatched area 608 of the sheet 108. These sensors may require sheet stabilization in order to take proper measurements, so the vented guide rollers 606*a*-606*b* are provided here. Other sensors 604 may not require sheet stabilization and can therefore be located over other areas of the sheet 108.

The elements shown in FIGS. 6A and 6B could be stationary or movable. For example, the sensor carriages 602*a*-602*b* and the guide rollers 606*a*-606*b* could move across the sheet 108 to allow the sensors to measure different areas of the sheet 108.

Figure 6C:
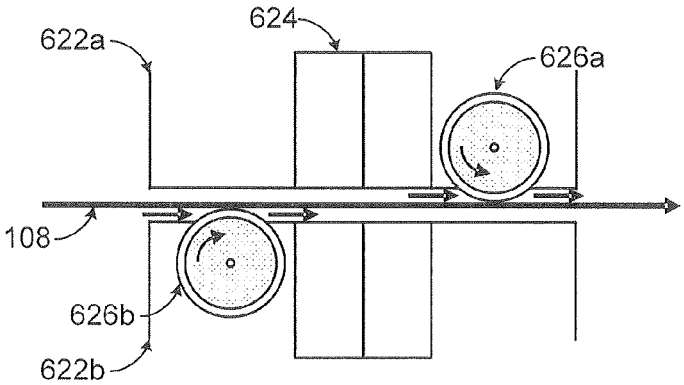
Figure 6D:
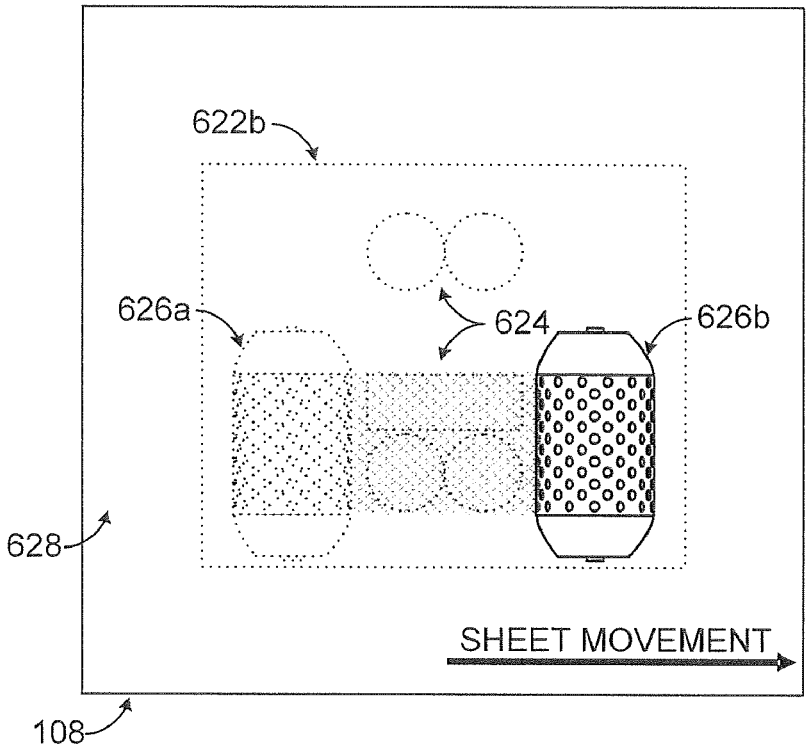

As shown in FIGS. 6C and 6D, two sensor carriages 622*a*-622*b* each include multiple sensors 624. Also, a vented guide roller 626*a* is positioned after the sensors 624 within the sensor carriage 622*a*, and a vented guide roller 626*b* is positioned prior to the sensors 624 within the sensor carriage 622*b*. The guide rollers 626*a*-626*b* could represent any suitable vented rollers for stabilizing a sheet 108, including the rollers shown in FIGS. 3A through 5B discussed above. In FIG. 6D, the upper sensor carriage 622*a* has been omitted (apart from its vented guide roller) for clarity, and the lower sensor carriage 622*b* and its components are illustrated in dotted lines since they are located under the sheet 108 in FIG. 6D.

Again, in this example, some of the sensors 624 take measurements of a stabilized portion of the sheet 108, which is denoted by the cross-hatched area 628 of the sheet 108. Other sensors 624 may not require sheet stabilization and can therefore be located over other areas of the sheet 108. Also, the elements shown in FIGS. 6C and 6D could be stationary or movable, such as when the sensor carriages 622*a*-622*b* (including the guide rollers 626*a*-626*b*) could move across the sheet 108 to allow the sensors to measure different areas of the sheet 108.

Figure 6E:
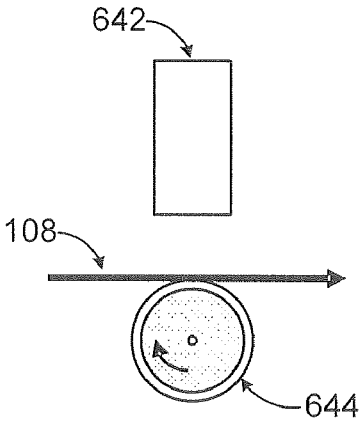
Figure 6F:
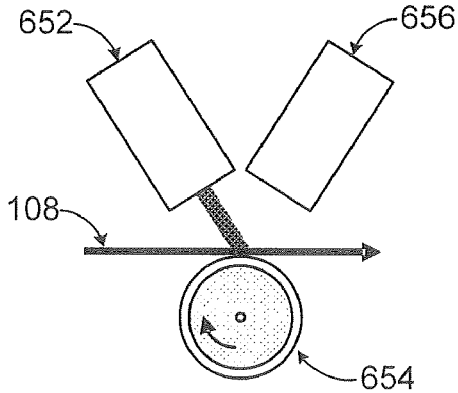

As shown in FIGS. 6E through 6H, one or more sensors could also or alternatively be positioned to take measurements of a sheet 108 at a vented guide roller. For example, as shown in FIG. 6E, a sensor 642 can take sensor measurements of the sheet 108 in an area where the sheet 108 attaches or is attached to a guide roller 644. In FIG. 6F, an illuminator 652 can illuminate a portion of the sheet 108 in an area where the sheet 108 attaches or is attached to a guide roller 654. A detector 656 could then take measurements of the illuminated portion of the sheet 108. The illuminator 652 could represent any suitable source of illumination, such as one or more bulbs, light emitting diodes, or other light source(s). The detector 656 could represent any suitable detection device, such as an imaging device or a detector or other device for taking reflected/scattered radiance measurements from an illuminated sheet or portion thereof.

In FIGS. 6E and 6F, where the sheet 108 attaches to the guide roller 644 or 654, the sheet position may be maximally confined and known with the greatest accuracy. This may allow for various measurements to take place, such as triangulation of sheet thickness or other measurements that require accurate positioning of the sheet. Other measurements that could occur in this manner include measurements of sheet surface roughness, measurements of the variability of reflected/scattered radiance from an illuminated spot, and measurements of sheet surface topography or other surface relief (such as embossed or pressed features from forming fabrics, press rolls, or dandy rolls). Yet other measurements could include measurements of applied markings (such as printed patterns, local discoloration, or smears) and the detection and measurement of continuum defects and structural imperfections (such as cracks, pinholes, or inclusions of dirt or debris). The illumination and/or detection in FIGS. 6E and 6F could occur at any suitable angle(s) (including oblique angles) and could include image-based detection for an illuminated area.

Figure 6G:
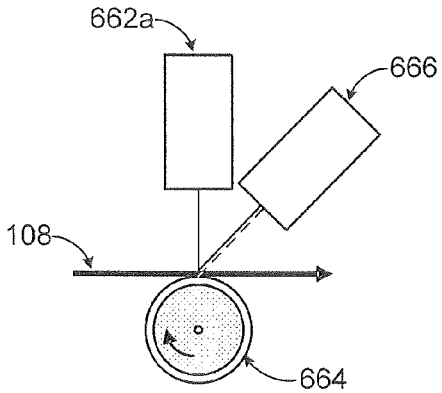
Figure 6H:
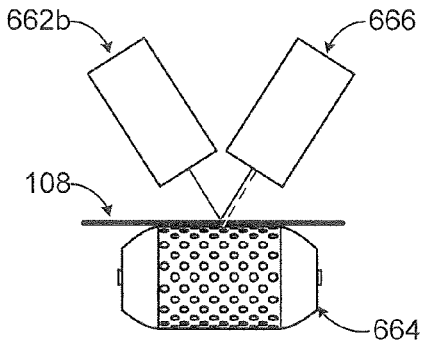

FIGS. 6G and 6H illustrate specific examples of the use of measurements at a vented guide roller. In these examples, a projector 662*a* or 662*b* (which are placed at different angles to a sheet 108 in FIGS. 6G and 6H) illuminates a portion of the sheet 108 where the sheet 108 attaches or is attached to a guide roller 664. A detector 666 could then take measurements of the illuminated portion of the sheet 108. This arrangement could be used to take caliper/thickness measurements of the sheet 108. This could involve triangulation of the sheet thickness by measuring the position of an illuminated spot, line, or pattern or the path of a reflected beam from the sheet 108. In general, a reflected beam follows different paths (denoted by solid and dashed lines) depending on the sheet thickness and whether a sheet is present at all. Alternatively, the imaged position of an illuminated spot, line, or pattern may change with sheet thickness or with and without a sheet.

In particular embodiments, a line illumination can be used along the length of the guide roller 664, allowing thickness measurements to be taken at multiple positions of the sheet. A reference position can be determined without the sheet 664 present, such as during a process interruption or by traversing the projector and the detector past the edge of the sheet 664. Once traversed past the edge of the sheet, a mechanism can be used to discriminate between the roller surface and any apertures or groove in the roller surface (such as when no reflection is seen or when the illuminated position is out of an acceptable range).

Although FIGS. 6A through 6H illustrate various additional mechanisms for stabilizing a moving sheet relative to a sensor, various changes may be made to FIGS. 6A through 6H. For example, a sensor carriage could include any suitable arrangement of sensors and vented guide rollers, whether the vented guide rollers are internal or external to the sensor carriage.

Figure 7:
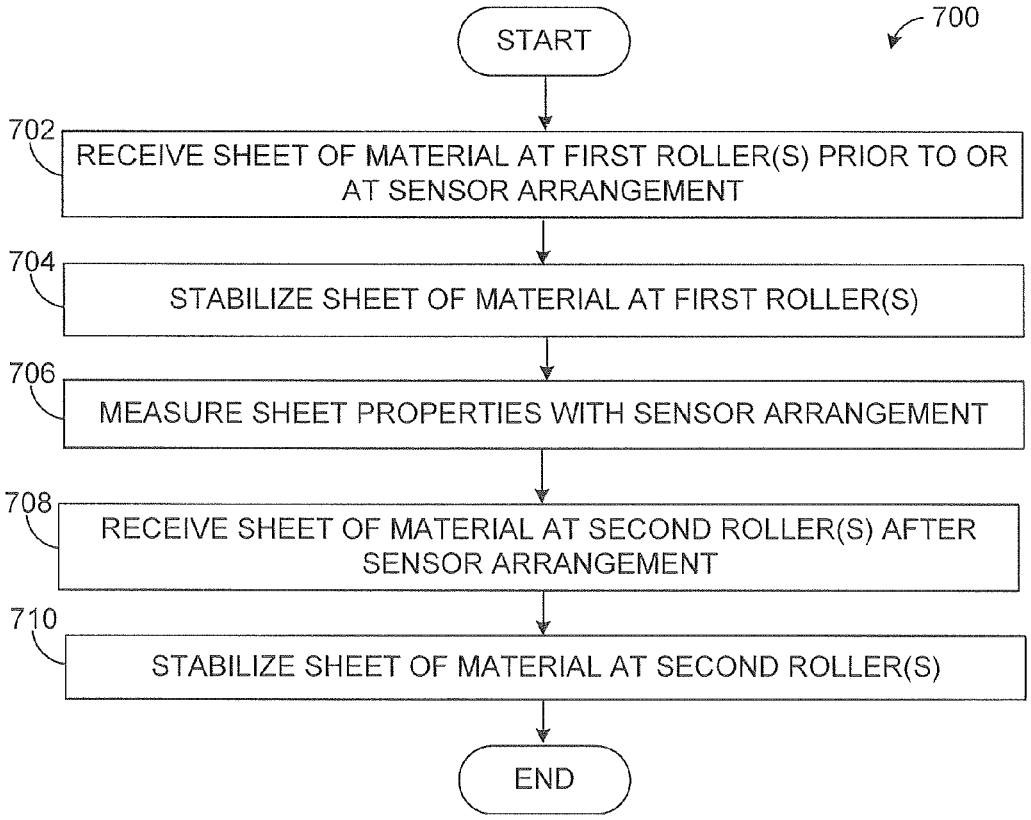
FIG. 7 illustrates an example method for stabilizing a moving sheet relative to a sensor according to one embodiment of this disclosure.

FIG. 7 illustrates an example method 700 for stabilizing a moving sheet relative to a sensor according to one embodiment of this disclosure. The embodiment of the method 700 shown in FIG. 7 is for illustration only. Other embodiments of the method 700 could be used without departing from the scope of this disclosure. Also, for ease of explanation, the method 700 in FIG. 7 is described as involving the use of one or more of the vented guide rollers shown in FIGS. 3A through 5B in the system 100 of FIG. 1. The method 700 could be used with any other suitable guide rollers and systems.

A sheet 108 is received at one or more first guide rollers (prior to reaching a sensor arrangement, or at the sensor arrangement) at step 702 and stabilized at step 704. This may include, for example, receiving the sheet 108 at one or more vented guide rollers 212, 214*a*-214*b*. This may also include drawing at least a portion of one or more boundary layers of air into the one or more vented guide rollers 212, 214*a*-214*b* at the ingress of the guide rollers. This may further include exhausting air to reform at least a portion of one or more boundary layers of air at the egress of the guide rollers. The air could, for example, pass through grooves 304, through openings 404, or between rings 502 in the vented guide rollers.

One or more properties of the sheet 108 are measured at step 706. This could include, for example, the sensors 206 taking measurements of the sheet 108. Any suitable measurements can occur here, such as gloss measurements involving illumination at 75° and measurement at 75°, 45/0 color measurements involving illumination at 45° and measurement at 0°, or d/0 color measurements involving diffuse illumination and measurement at 0°. The sheet 108 can be held relatively constant at a desired position or plane in the gap 204 between the sensor carriages 202*a*-202*b* during the measurements. In addition or alternatively, the sheet could be measured at one or more vented guide rollers, such as is shown in FIGS. 6E through 6H.

The sheet 108 is received at one or more guide rollers after exiting the sensor arrangement at step 708 and stabilized at step 710. This may include, for example, receiving the sheet 108 at one or more vented guide rollers 216, 218*a*-218*b*. This may also include drawing at least a portion of one or more boundary layers of air into the one or more vented guide rollers 216, 218*a*-218*b* at the ingress of the guide rollers. This may further include exhausting air to reform at least a portion of one or more boundary layers of air at the egress of the guide rollers.

In this way, the vented guide rollers can help to stabilize the position and planarity of the sheet 108 within the sensor gap 204. Among other things, this may allow more accurate measurements of the sheet 108 to be taken.

Although FIG. 7 illustrates one example of a method 700 for stabilizing a moving sheet 108 relative to a sensor, various changes may be made to FIG. 7. For example, not all of the steps may be performed to stabilize a sheet 108. For example, the sheet 108 could be stabilized using one or more guide rollers on only one side of the sensor gap 204, and either steps 702-704 or steps 708-710 could be omitted. Also, the sheet 108 could be stabilized using or more guide rollers at the location where sensor readings occur, whether or not additional guide rollers are provided before and/or after the sensor taking the readings.

It may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

receiving a sheet of material at a sensor assembly, the sensor assembly including a sensor configured to measure a property of the sheet; and stabilizing the sheet with respect to the sensor using a guide roller;

wherein the guide roller comprises a central axle configured to be rotated and a surface defining a substantially hollow space within the guide roller, the surface having a plurality of openings configured to allow air to enter and exit the hollow space of the guide roller through the openings; and wherein stabilizing the sheet comprises redirecting the air entering the guide roller using a deflector located within the guide roller, the deflector comprising a plate separated from the central axle by a space, the deflector configured to redirect the air entering the guide roller.

2. The method of claim 1, wherein stabilizing the sheet comprises stabilizing the sheet using multiple guide rollers.

3. The method of claim 2, wherein the multiple guide rollers comprise one or more guide rollers located prior to the sensor assembly and one or more guide rollers located after the sensor assembly.

4. The method of claim 1, wherein the deflector is configured to be stationary while the guide roller rotates.

5. The method of claim 1, wherein the sensor is configured to measure the property of the sheet at a location where the sheet is attached to the guide roller.

6. The method of claim 1, wherein stabilizing the sheet further comprises using the guide roller to remove at least a portion of a first boundary layer of air moving towards the guide roller and to reform at least a portion of a second boundary layer of air moving away from the guide roller.

7. A system comprising:

a sensor assembly including a sensor configured to measure a property of a sheet; and a guide roller that comprises a central axle configured to be rotated and a surface defining a substantially hollow space within the guide roller, the surface having a plurality of openings configured to allow air to enter and exit the guide roller through the openings;

wherein the guide roller further comprises a deflector located within the surface of the guide roller, the deflector comprising a plate separated from the central axle by a space, the deflector configured to redirect the air entering the guide roller.

8. The system of claim 7, wherein the system comprises multiple guide rollers.

9. The system of claim 7, wherein the deflector is configured to be stationary while the guide roller rotates.

10. The system of claim 7, wherein the sensor is configured to measure the property of the sheet at a location where the sheet is attached to the guide roller.

11. The system of claim 7, wherein the guide roller is configured to remove at least a portion of a first boundary layer of air moving towards the guide roller and to reform at least a portion of a second boundary layer of air moving away from the guide roller.

12. The system of claim 7, wherein the guide roller comprises two tapered ends.

13. The system of claim 12, wherein the plurality of openings in the surface of the guide roller are not located in the tapered ends of the guide roller.

14. A guide roller comprising:

a central axle configured to be rotated;

a surface defining a substantially hollow space within the guide roller, the surface having a plurality of openings configured to allow air to enter and exit the hollow space of the guide roller through the openings; and a deflector located within the hollow space of the guide roller, the deflector comprising a flat plate separated from the central axle by a space, the deflector configured to redirect the air entering the guide roller.

15. The guide roller of claim 14, wherein the guide roller is configured to remove at least a portion of a first boundary layer of air moving towards the guide roller and to reform at least a portion of a second boundary layer of air moving away from the guide roller.

16. The guide roller of claim 14, wherein the openings are located in a shell surface of the guide roller, the shell surface comprising an exterior of the guide roller.

17. The guide roller of claim 14, wherein the deflector is further configured to redirect the air entering the guide roller from an "attachment" side of the guide roller to a "detachment" side of the guide roller.

18. The guide roller of claim 14, wherein the guide roller comprises two tapered ends.

19. The guide roller of claim 18, wherein the openings in the surface of the guide roller are not located in the tapered ends of the guide roller.

20. The guide roller of claim 14, wherein the guide roller is configured to attach to a sheet of material moving over the guide roller at a location where a sensor measures a property of the sheet.

* * * * *